US009739183B2

(12) United States Patent
Son et al.

(10) Patent No.: US 9,739,183 B2
(45) Date of Patent: Aug. 22, 2017

(54) CONTINUOUS VARIABLE VALVE DURATION SYSTEM AND ENGINE PROVIDED WITH THE SAME

(71) Applicant: HYUNDAI MOTOR COMPANY, Seoul (KR)

(72) Inventors: You Sang Son, Suwon-si (KR); Kyoung Pyo Ha, Seongnam-si (KR); Back Sik Kim, Osan-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 13 days.

(21) Appl. No.: 14/941,130

(22) Filed: Nov. 13, 2015

(65) Prior Publication Data

US 2016/0369668 A1 Dec. 22, 2016

(30) Foreign Application Priority Data

Jun. 19, 2015 (KR) ..... 10-2015-0087550

(51) Int. Cl.
*F01L 1/34* (2006.01)
*F01L 13/00* (2006.01)
(Continued)

(52) U.S. Cl.
CPC ..... *F01L 13/0015* (2013.01); *F01L 1/047* (2013.01); *F01L 1/26* (2013.01); *F01L 1/267* (2013.01);
(Continued)

(58) Field of Classification Search
CPC ..... F01L 13/0015; F01L 1/047; F01L 1/26; F01L 1/267; F01L 13/0026; F01L 2013/0052; F01L 2013/103
See application file for complete search history.

(56) References Cited

U.S. PATENT DOCUMENTS 5,924,334 A 7/1999 Hara et al.
7,721,691 B2 5/2010 Tateno
7,770,550 B2 * 8/2010 Tanabe ..... F01L 13/0021 123/90.16

FOREIGN PATENT DOCUMENTS

EP 2322771 A1 5/2011
JP 06-185321 A 7/1994
(Continued)

*Primary Examiner* — Zelalem Eshete
(74) *Attorney, Agent, or Firm* — Brinks Gilson & Lione

(57) ABSTRACT

A continuous variable valve duration system may include a camshaft, a cam portion having a cam is formed thereto. The camshaft is inserted to the cam portion such that a relative phase angle with respect to the camshaft is variable. The camp portion has a cam cap engaging portion, and an inner bracket transmits rotation of the camshaft to the cam portion. A slider housing has the inner bracket rotatably inserted thereto, of which relative position with respect to the camshaft is variable, and of which a control slot is formed. Cam caps rotatably mount the cam cap engaging portion to a cylinder head, and a control portion comprising an eccentric control shaft inserted into the control slot. A worm wheel is connected to the eccentric control shaft, and a worm gear engaged with the worm wheel and a control motor selectively rotates the worm gear so as to change relative position of the slider housing with respect to the camshaft and a cylinder head cover of which a motor mounting portion where the control motor is mounted thereto.

15 Claims, 11 Drawing Sheets

(51) Int. Cl.
*F01L 1/047* (2006.01)
*F01L 1/26* (2006.01)

(52) U.S. Cl.
CPC ... *F01L 13/0026* (2013.01); *F01L 2013/0052* (2013.01); *F01L 2013/103* (2013.01)

(56) References Cited

FOREIGN PATENT DOCUMENTS

| | | | |
|---|---|---|---|
| JP | 09-041924 | A | 2/1997 |
| JP | 5582195 | B2 | 9/2014 |
| KR | 101326818 | B1 | 11/2013 |

* cited by examiner

CONTINUOUS VARIABLE VALVE DURATION SYSTEM AND ENGINE PROVIDED WITH THE SAME

CROSS-REFERENCE TO RELATED APPLICATION

This application claims priority to and the benefit of Korean Patent Application No. 10-2015-0087550 filed on Jun. 19, 2015, the entire contents of which are incorporated herein by reference.

FIELD

The present disclosure relates to a continuous variable valve duration system and an engine provided with the same.

BACKGROUND

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various research, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The above information disclosed in this Background section is only for enhancement of understanding of the present disclosure and may contain information that is not already known to a person of ordinary skill in the art.

SUMMARY

Various aspects of the present disclosure include directly providing a continuous variable valve duration system and an engine provided with the same which may vary opening duration of a valve according to operation conditions of an engine, with a simple construction.

According to various aspects of the present disclosure, a continuous variable valve duration system may include a camshaft, a cam portion of which a cam is formed thereto, of which the camshaft is inserted thereto, of which relative phase angle with respect to the camshaft is variable, and of which a cam cap engaging portion is formed thereto, an inner bracket transmitting rotation of the camshaft to the cam portion, a slider housing of which the inner bracket is rotatably inserted thereto, of which relative position with respect to the camshaft is variable, and of which a control slot is formed to, cam caps rotatably mounting the cam cap engaging portion to a cylinder head, a control portion comprising an eccentric control shaft inserted into the control slot, a worm wheel connected to the eccentric control shaft, a worm gear engaged with the worm wheel and a control motor selectively rotating the worm gear so as to change relative position of the slider housing with respect to the camshaft and a cylinder head cover of which a motor mounting portion where the control motor is mounted thereto.

The motor mounting portion may be inclined to a side direction of the cylinder head cover.

The cam portion may include a first and second cam portions, the cam may be provided as a pair and be formed to the first and second cam portions respectively, and the cam cap engaging portion may be formed between the cams respectively, and the inner bracket may include a first and second inner brackets transmitting rotation of the camshaft to the first and second cam portions respectively.

One form of the continuous variable valve duration system may further include a guide protruded portion formed to an upper portion of the slider housing and a connecting bracket connecting the cam caps and of which a guide slot for the guide protruded portion to be inserted thereto is formed thereto for guiding movement of the slider housing.

A first and a second sliding holes may be formed to the first and second inner brackets respectively, a slider pin inserted into the camshaft may be rotatably inserted into the first sliding hole, a cam key may be formed to the first and second cam portions respectively and a cam pin of which a cam key slot for the cam key to be slidably inserted thereto is formed thereto may be slidably inserted into the second sliding hole respectively.

The slider pin may include a pin body connected to the camshaft and a pin head connected with the pin body and rotatably inserted into the first sliding hole.

The continuous variable valve duration system may further include a double row bearing disposed within the slider housing and connected with the first and second inner brackets.

A shaft hole may be formed between each cam cap and the connecting bracket for the eccentric control shaft to be inserted thereto.

The first and second cam portions may be provided as plural and the slider housing may be provided two or more and wherein one control portion may change the relative positions of the slider housings with respect to the camshaft.

According to various aspects of the present disclosure, an engine may include a camshaft, at least two of a first and a second cam portions of which two cams are formed thereto respectively, of which the camshaft is inserted thereto, of which relative phase angles with respect to the camshaft are variable, and of which a cam cap engaging portion is formed between the cams respectively, first and second inner brackets transmitting rotation of the camshaft to the first and second cam portions respectively, at least two of slider housings of which the first and second inner brackets are rotatably inserted thereto, of which relative positions with respect to the camshaft is variable and of which a guide protruded portion is formed to an upper side thereof respectively, at least four of cam caps of which each cam cap engaging portion is rotatably connected thereto, connecting brackets connecting the cam caps and of which a guide slot for the guide protruded portion to be inserted thereto for guiding movement of the slider housing is formed thereto respectively, a control portion comprising an eccentric control shaft inserted into the control slot, a worm wheel connected to the eccentric control shaft, a worm gear engaged with the worm wheel and a control motor selectively rotating the worm gear so as to change relative position of the slider housing with respect to the camshaft and a cylinder head cover of which a motor mounting portion where the control motor is mounted thereto.

The motor mounting portion may be inclined to a side direction of the cylinder head cover.

A first and a second sliding holes may be formed to the first and second inner brackets respectively, a slider pin inserted into the camshaft may be rotatably inserted into the first sliding hole, a cam key may be formed to the first and second cam portions respectively and a cam pin of which a cam key slot for the cam key to be slidably inserted thereto is formed thereto may be slidably inserted into the second sliding hole respectively.

The slider pin may include a pin body connected to the camshaft and a pin head connected with the pin body and rotatably inserted into the first sliding hole.

The engine may further include a double row bearing disposed within the slider housing and connected with the first and second inner brackets.

A shaft hole may be formed between each cam cap and the connecting bracket for the eccentric control shaft to be inserted thereto.

As described above, a continuous variable valve duration system according to an embodiment of the present disclosure may vary an opening duration of a valve according to operation conditions of an engine, with a simple construction.

The continuous variable valve duration system according to embodiment of the present disclosure may be reduced in size and thus the entire height of a valve train may be reduced.

Since the continuous variable valve duration system may be applied to an existing engine without excessive modification, thus productivity may be enhance and production cost may be reduced.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
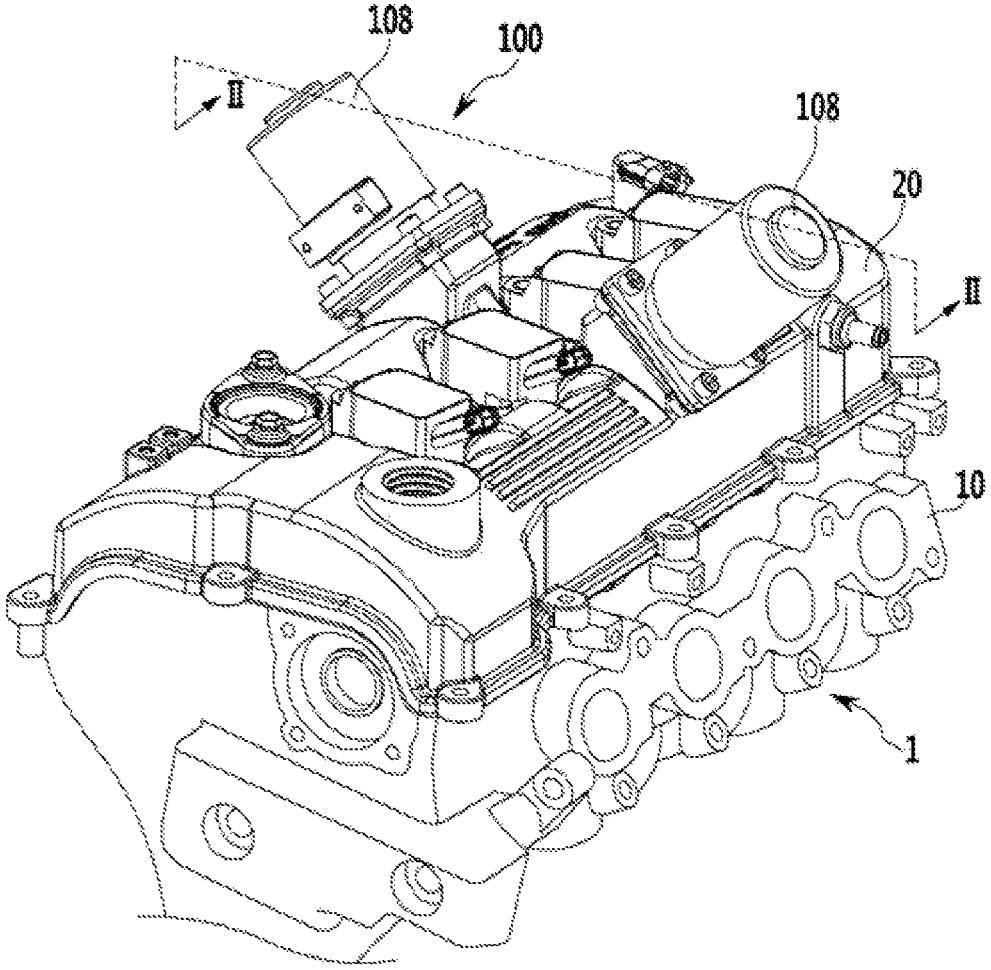
FIG. 1 is a perspective view of an engine provided with a continuous variable valve duration system according to an embodiment of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features In the following detailed description, only certain embodiments of the present disclosure have been shown and described, simply by way of illustration.

As those skilled in the art would realize, the described embodiments may be modified in various different ways, all without departing from the spirit or scope of the present disclosure The same or similar elements will be designated by the same reference numerals throughout the specification.

In the drawings, the thickness of layers, films, panels, regions, etc., may be exaggerated for clarity.

An embodiment of the present disclosure will hereinafter be described in detail with reference to the accompanying drawings.

Figure 2:
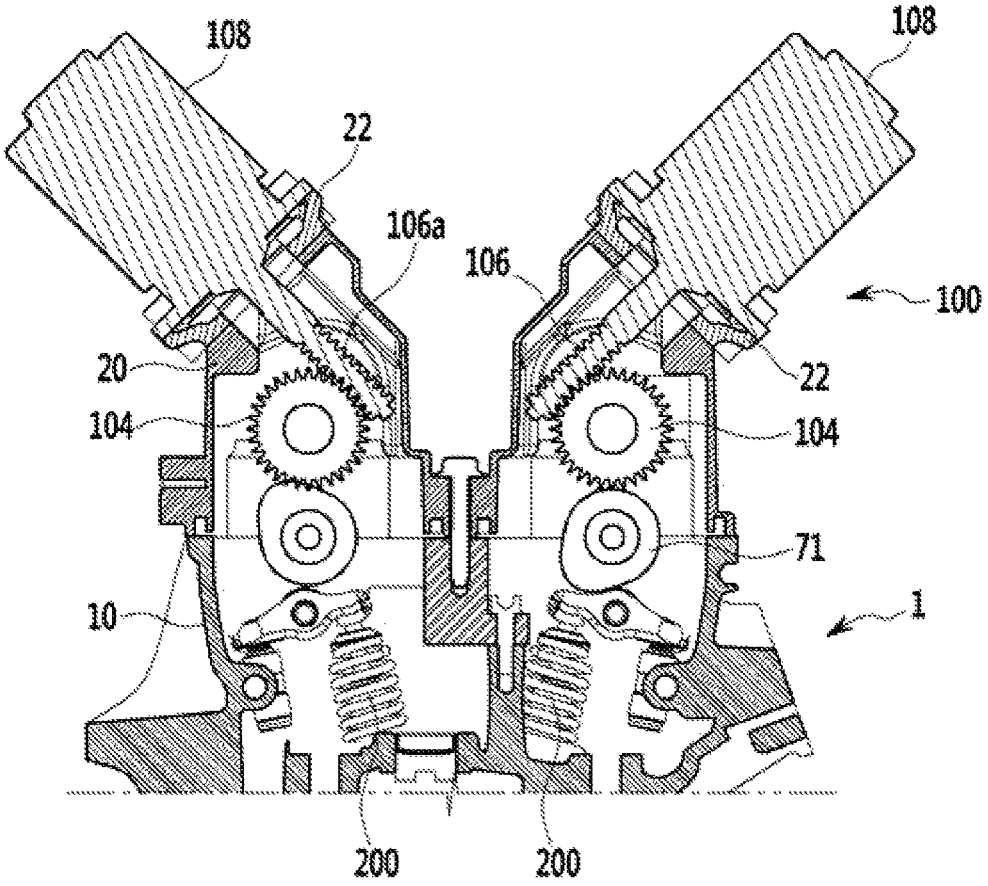
FIG. 2 is a cross-sectional view along a line II-II of FIG. 1.
Figure 3:
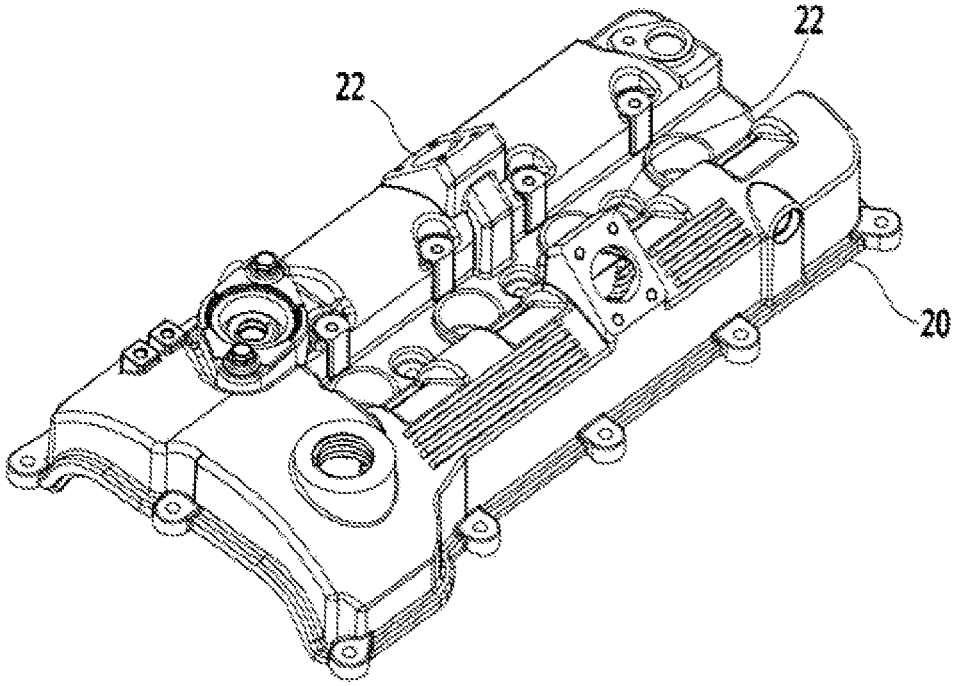
FIG. 3 is a perspective view of a head cover provided to an engine according to an embodiment of the present disclosure.

FIG. 1 is a perspective view of an engine provided with a continuous variable valve duration system according to an embodiment of the present disclosure, FIG. 2 is a cross-sectional view along a line II-II of FIG. 1 and FIG. 3 is a perspective view of a head cover provided to an engine according to an embodiment of the present disclosure.

Figure 4:
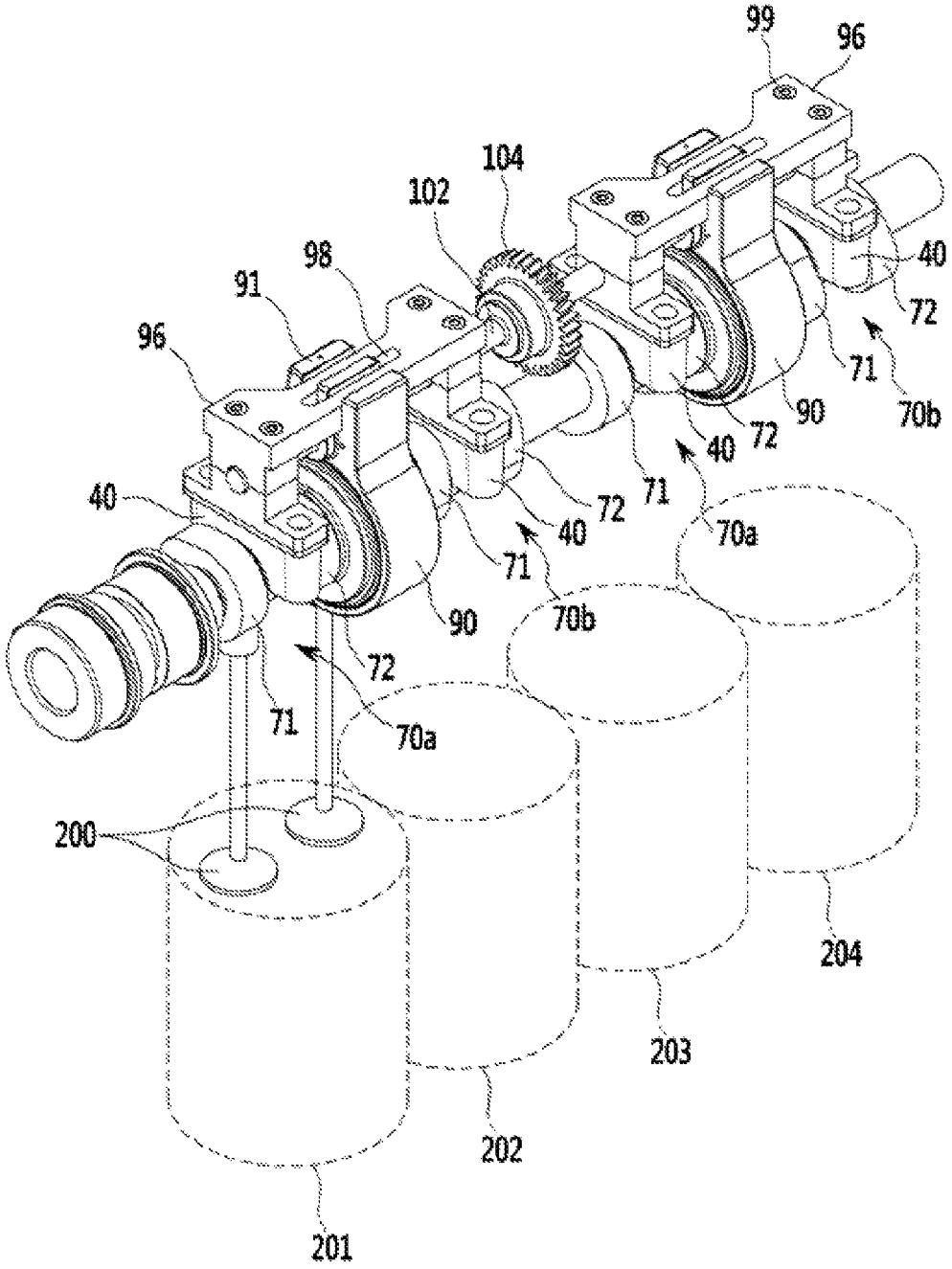
FIG. 4 is a perspective view of a continuous variable valve duration system according to an embodiment of the present disclosure.
Figure 5:
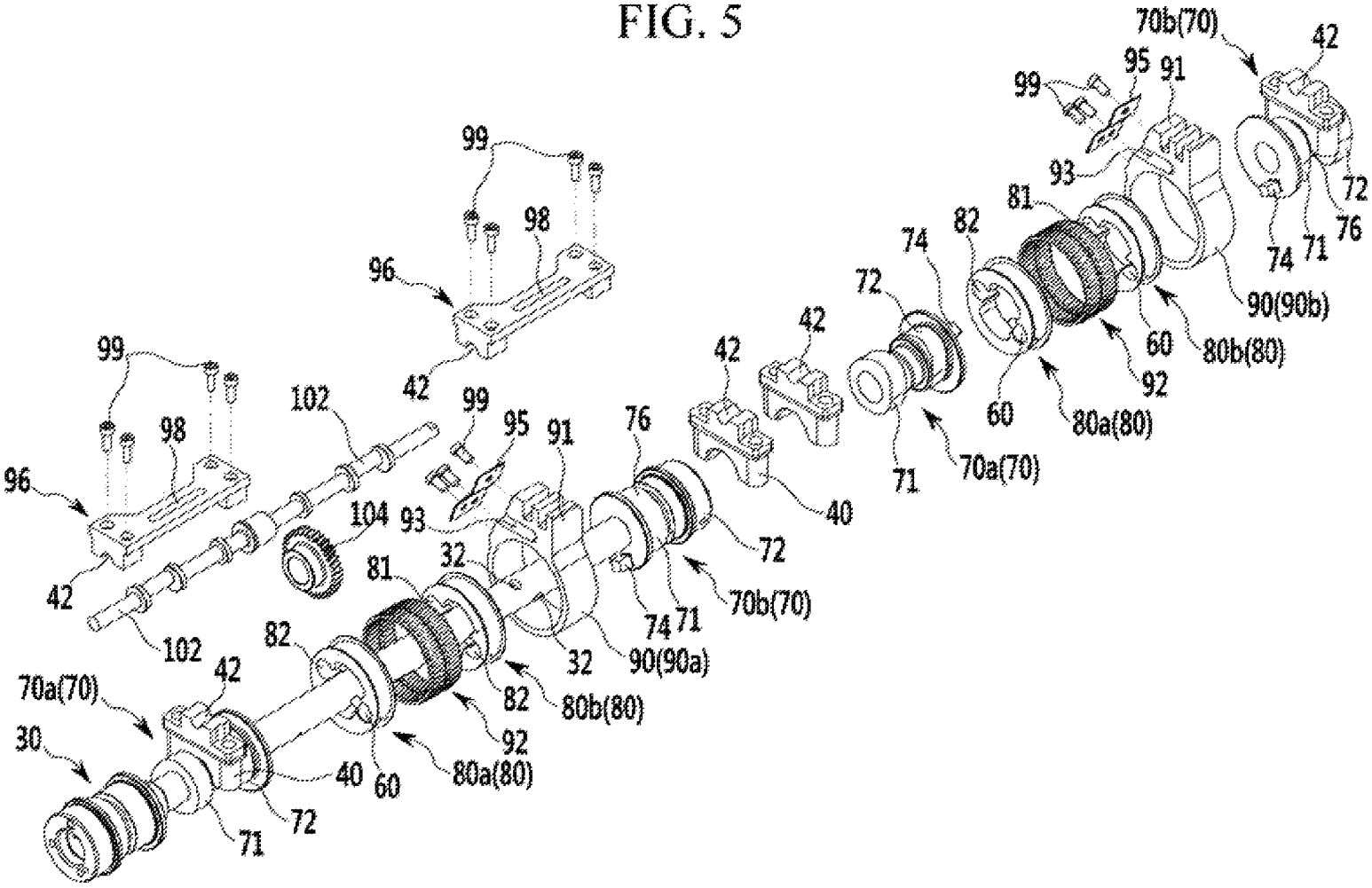
FIG. 5 and FIG. 6 are exploded perspective views of a continuous variable valve duration system according to an embodiment of the present disclosure.
Figure 6:
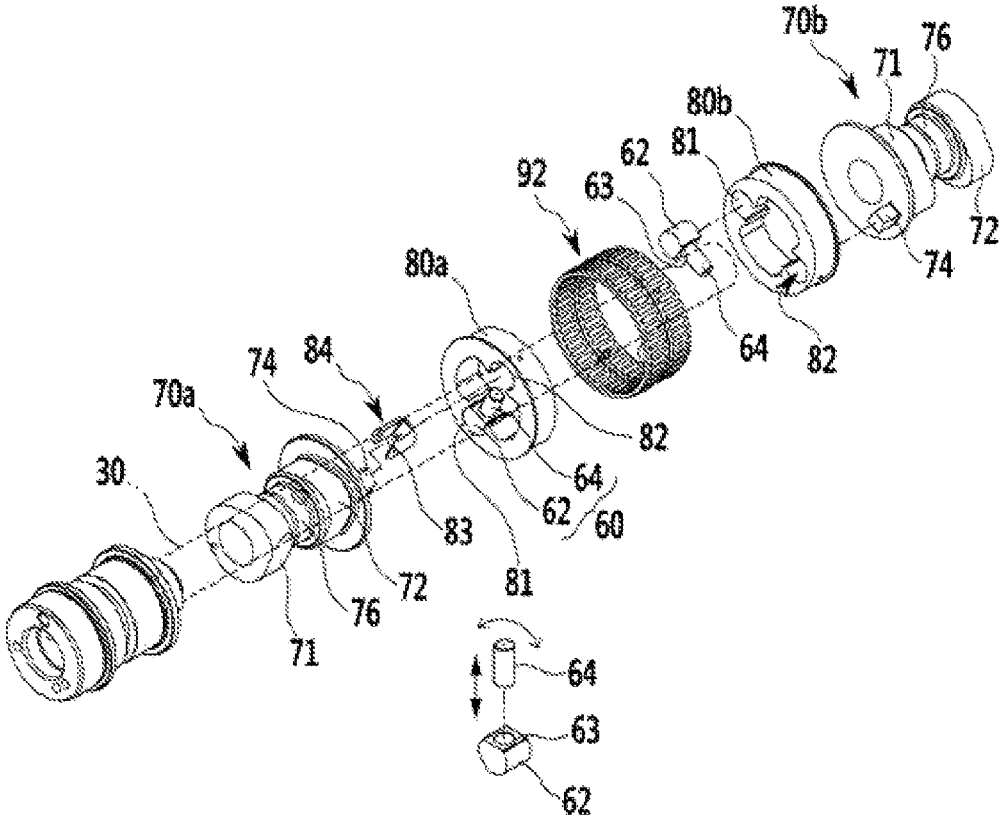

FIG. 4 is a perspective view of a continuous variable valve duration system according to an embodiment of the present disclosure and FIG. 5 and FIG. 6 are exploded perspective views of a continuous variable valve duration system according to an embodiment of the present disclosure.

Referring to FIGS. 1 to 6, an engine 1 according to an embodiment of the present disclosure includes a cylinder head 10 and a continuous variable valve duration system mounted to the cylinder head 10.

In the drawings, the engine includes four (4) cylinders 201, 202, 203 and 204 (FIG. 4), but is not limited thereto.

As best seen in FIGS. 4 and 5, the continuous variable valve duration system includes a camshaft 30, a cam portion 70 having a cam 71 (and/or can 72) formed thereto. The cam portion 70 has the camshaft 30 is inserted thereto. A relative phase angle with respect to the camshaft 30 is variable, and a cam cap engaging portion 76 is formed thereto, with an inner bracket 80 transmitting rotation of the camshaft 30 to the cams 71, 72. The inner bracket 80 is rotatably inserted to a slider housing 90, of which relative position with respect to the camshaft 30 is variable, and has a control slot 93 formed therein. Cam caps 40 rotatably mount the cam cap engaging portion 76 to the cylinder head 10, and a control portion 100 including an eccentric control shaft 102 is inserted into the control slot 93. A worm wheel 104 is connected to the eccentric control shaft 102, and a worm gear 106 is engaged with the worm wheel 104. A control motor 108 (FIG. 2) selectively rotates the worm gear 106 so as to change relative position of the slider housing 90 with respect to the camshaft 30 and a cylinder head cover 20 having a motor mounting portion 22 where the control motor 108 is mounted thereto.

The continuous variable valve duration system according to an embodiment of the present disclosure may be applied to change duration of intake valves, or of exhaust valves, or of intake valves and exhaust valves as shown in drawings.

The cams 71, 72 contact stems or rods to open valve(s) 200.

The motor mounting portion 22 is inclined to a side direction of the cylinder head cover 20. Thus, maintainability of the system may be enhanced and layout may be simplified.

The cam 71, 72 may be formed as a pair of cams 71 and 72 as shown in the drawings, and the cam cap engaging portion 76 is formed between the cams 71 and 72.

The cam portion 70 may include first and second cam portions 70*a* and 70*b*, and the inner bracket 80 may include first and second inner brackets 80*a* and 80*b* transmitting rotation of the camshaft 30 to the first and second cam portions 70*a* and 70*b* respectively.

A guide protruded portion 91 formed to an upper portion of the slider housing 90, and a connecting bracket 96 connects the cam caps 40 and has a guide slot 98 for the guide protruded portion 91 to be inserted thereto for guiding movement of the slider housing 90.

First and a second sliding holes 81 and 82 are formed to the first and second inner brackets 80*a* and 80*b*, respectively, and a slider pin 60 connected with the camshaft 30 is rotatably inserted into the first sliding hole 81. A cam key 74 is formed to the first and second cam portions 70*a* and 70*b*, respectively, and a cam pin 84 having a cam key slot 83 for the cam key 74 to be slidably inserted thereto is formed thereto, and is rotatably inserted into the second sliding hole 82.

The slider pin 60 includes a pin body 62 connected to the camshaft 30 through a camshaft hole 32 formed in the camshaft 30, and a pin head 64 is slidably connected with the pin body 62 and rotatably inserted into the first sliding hole 81. A slider pin hole 61 is formed to the pin head 64 and the pin body 62 is slidably inserted into the slider pin hole 61. As shown in FIG. 6, the pin head 64 is relatively movable along a length direction of the pin body 62 and the pin head 64 is rotatable in the first sliding hole 81.

A double row bearing 92 is disposed within the slider housing 90 and is connected with the first and second inner brackets 80*a* and 80*b*. Thus, the first and second inner bracket 80*a* and 80*b* are disposed within one slider housing 90 and may be rotated without interruption due to the double row bearing 92.

Also, since the first and second inner brackets 80*a* and 80*b* are disposed within one slider housing 90, the numbers of elements in the system may be reduced, and productivity may be improved and space for accommodating the continuous variable valve duration system may be reduced.

A slot cover 95 is connected to the slider housing 90 through bolts 96 to prevent the eccentric control shaft 102 from moving away from the control slot 93.

The cam caps 40 are connected with the connecting bracket 96 through bolts 99, and a shaft hole 42 where the eccentric control shaft 102 is inserted thereto is formed between the cam caps 40 and the connecting bracket 96, respectively. Since the eccentric control shaft 102 is inserted into the shaft hole 42, the eccentric control shaft 102 may be stably supported.

In the drawings, the continuous variable valve duration system according to various embodiments of the present disclosure is applied to an engine with four cylinders, but is not limited thereto. The continuous variable valve duration system according to various embodiments of the present disclosure may be applied to an engine with various cylinders, for example with six or more cylinders.

For easy comprehension, the continuous variable valve duration system which is applied to a four-cylinder engine will be discussed.

The continuous variable valve duration system may include a plurality of the first and second cam portions 70*a* and 70*b*, at least two of the slider housings 90*a* and 90*b* may be provided, and one control portion 100 changes the relative positions of the each slider housing 90*a* and 90*b*.

The connecting bracket 96 may be connected with two cam caps 40 respectively, and each of the slider housings 90*a* and 90*b* may be guided by the guide slot 98 of the connecting bracket 96.

Since the structure and functions of the inner brackets 80, the double row bearing 92 and so on are the same as described above, thus repeated explanation will be omitted.

Figure 7:
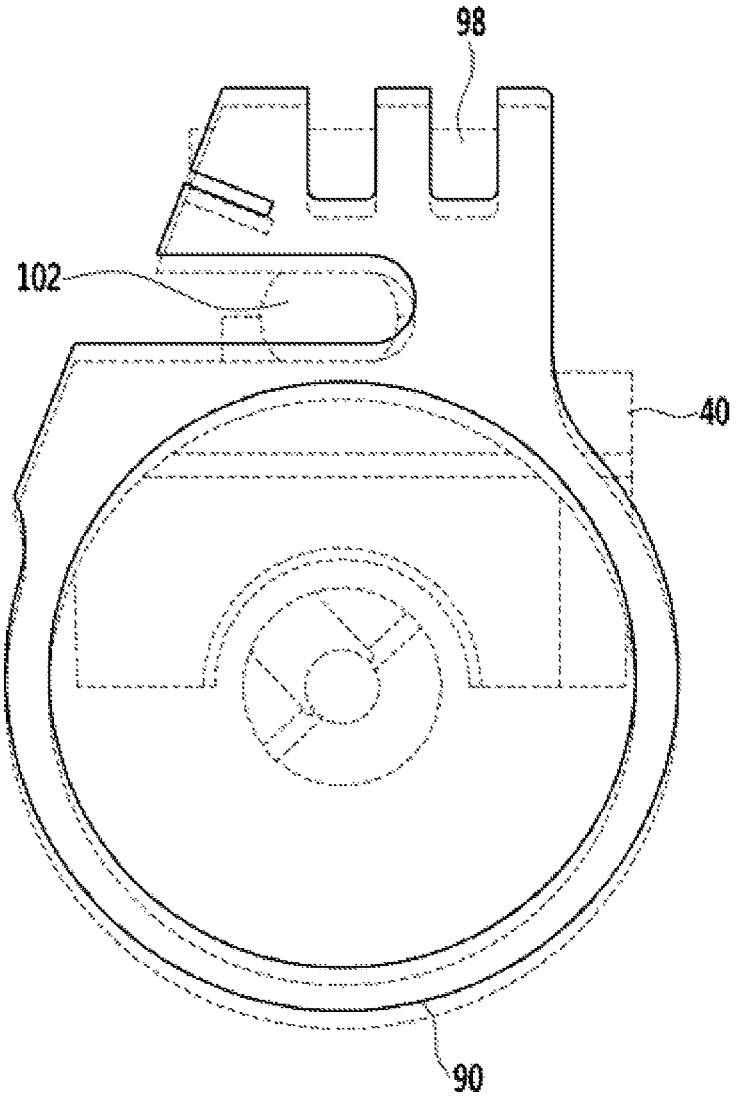
FIG. 7 and FIG. 8 are drawings showing operation of a continuous variable valve duration system according to an embodiment of the present disclosure.
Figure 8:
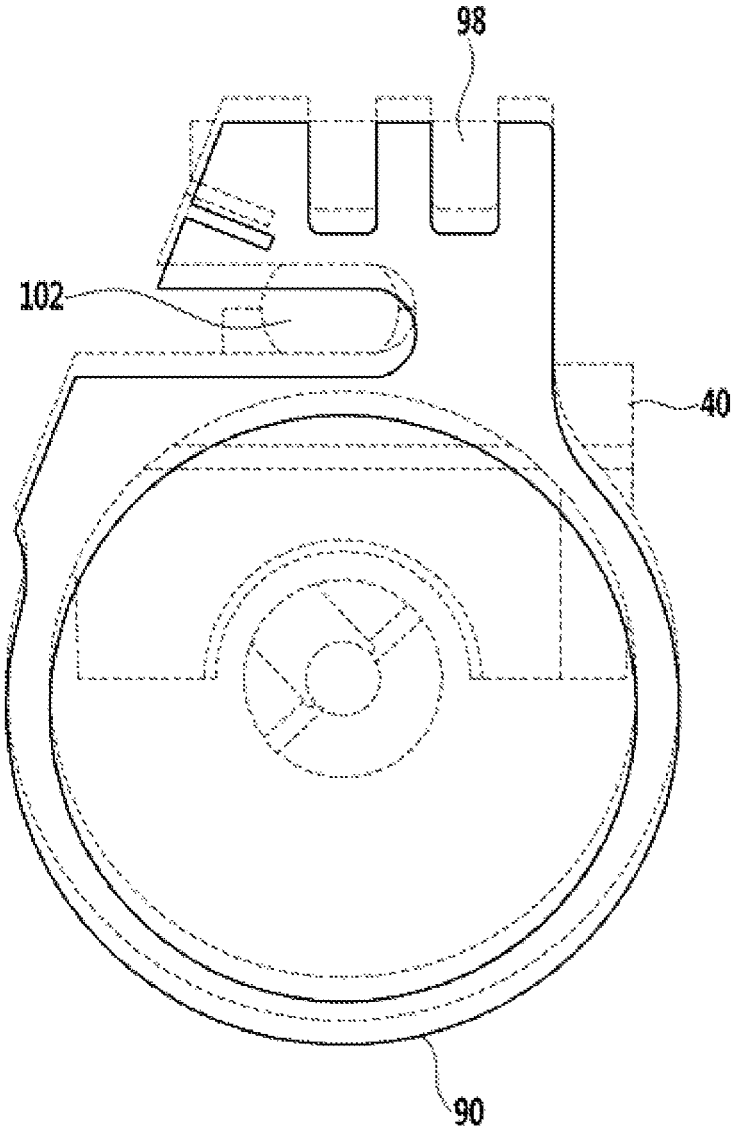

FIG. 7 and FIG. 8 are drawings showing operation of a continuous variable valve duration system according to an embodiment of the present disclosure.

Referring to FIG. 1 to FIG. 8, operations of the continuous variable valve duration system according to various embodiments of the present disclosure will be described.

According to engine operation states, an ECU (engine control unit or electric control unit) transmits control signals to the motor 108 of the control portion 100 to change the relative position of the slider housing 90.

For example, as shown in FIG. 7 when the control motor 108 rotates the eccentric control shaft 102 for the slider housing 90 to be moved, the rotation center of the inner bracket 80 moves upward with respect to the rotation center of the camshaft 30.

Dotted lines in the drawing indicate neutral state of which rotation centers of the camshaft 30 and the inner bracket 80 are the same and duration change and phase change are not occurred.

As shown in FIG. 8, when the control motor 108 rotates the eccentric control shaft 102 for the slider housing 90 to be moved, the rotation center of the inner bracket 80 moves downward with respect to the rotation center of the camshaft 30.

Similar to the FIG. 7 dotted lines in the drawing indicate neutral state of which rotation centers of the camshaft 30 and the inner bracket 80 are the same and duration change and phase change are not occurred.

Figure 9:
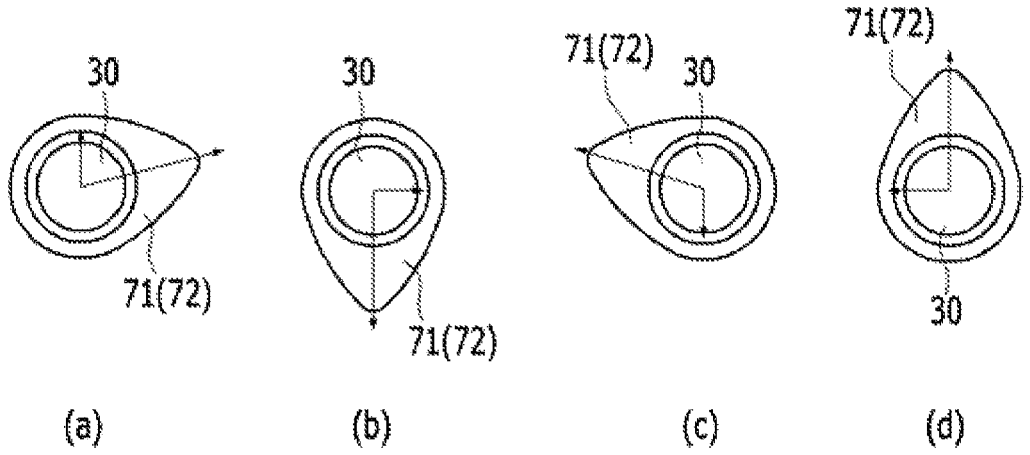
FIG. 9 and FIG. 10 are drawings showing mechanical motions of cams of a continuous variable valve duration system according to an embodiment of the present disclosure.
Figure 10:
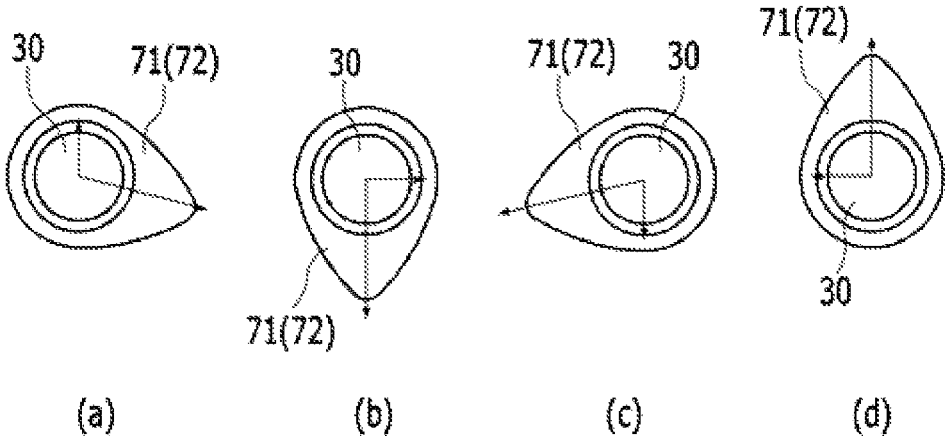

As shown in FIG. 7 and FIG. 8, when the control motor 108 rotates, the relative positions of the slider housing 90 and the inner bracket 80 with respect to the position of the camshaft 30 are changed FIG. 9 and FIG. 10 are drawings showing mechanical motions of cams of a continuous variable valve duration system according to an embodiment of the present disclosure.

As shown in FIG. 9, while the phase angle of the camshaft 30 is constantly changed when the relative rotation center of the cams 71 and 72 with respect to the rotation center of the camshaft 30 is changed downward, the rotation speed of the cams 71 and 72 is relatively faster than rotation speed of the camshaft 30 from phase a to phase b and from phase b to phase c, then the rotation speed of the cams 71 and 72 is relatively slower than rotation speed of the camshaft 30 from phase c to phase d and from phase d to phase a. That is, the valve duration is changed by shifting its opening/closing times.

As shown in FIG. 10, while the phase angle of the camshaft 30 is constantly changed when the relative rotation center of the cams 71 and 72 with respect to the rotation center of the camshaft 30 is changed upward, the rotation speed of the cams 71 and 72 is relatively slower than rotation speed of the camshaft 30 from phase a to phase b and from phase b to phase c, then the rotation speed of the cams 71 and 72 is relatively faster than rotation speed of the camshaft 30 from phase c to phase d and from phase d to phase a. That is, the valve duration is changed by shifting its opening/closing times.

Figure 11:
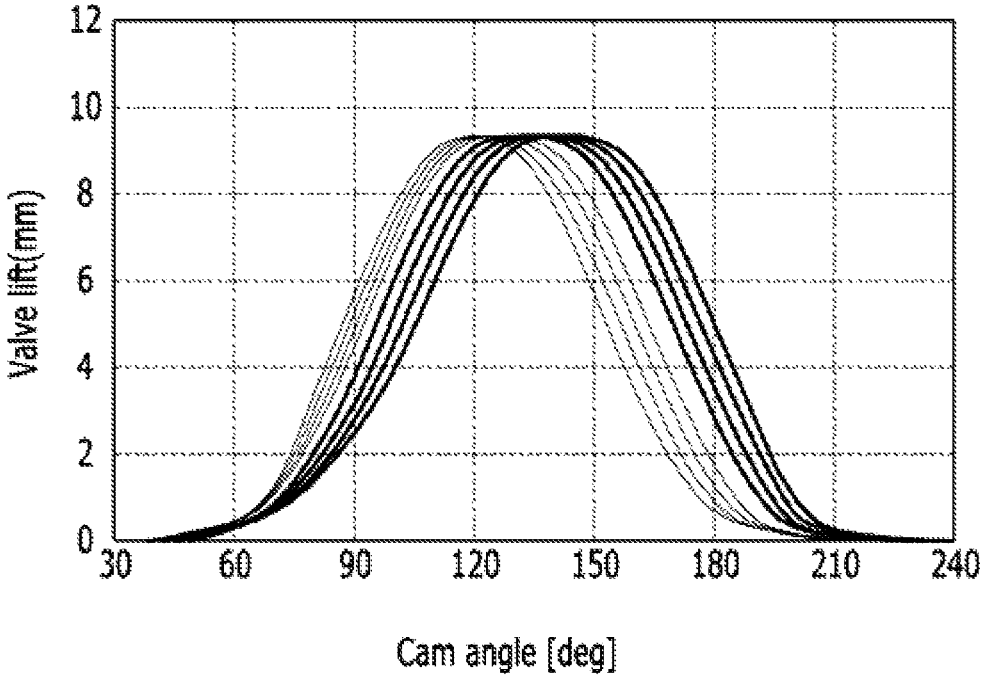
FIG. 11 is a graph of a valve profile of a continuous variable valve duration system according to an embodiment of the present disclosure.

FIG. 11 is a graph of a valve profile of a continuous variable valve duration system according to an embodiment of the present disclosure.

While the slider pin 60 is rotated together with the camshaft 30, the pin body 62 is slidable with respect to the pin head 64, the pin head 64 is rotatably inserted into the first sliding hole 81, the cam pin 84 is rotatably inserted into the second sliding hole 82, and the cam key 74 is slidable within the cam key slot 83. Thus, when the relative rotation centers of the inner bracket 80 and the camshaft 30 are changed, the relative rotation speed of the cams 71 and 72 with respect to the rotation speed of the camshaft 30 is changed.

That is, as shown in FIG. 11, although maximum lift of the valve 200 is constant, however rotation speed of the cam 71 and 72 with respect to the rotation speed of the camshaft 30 is changed according to relative positions of the slider housing 90 so that closing and opening time of the valve 200 is changed. That is, duration of the valve 200 is changed.

While opening time of the valve 200 is constant, and the closing time of the valve 200 is changed in FIG. 11, the present disclosure is not limited thereto. According to various mounting angles of the cams 71 and 72 and the valve 200, various contacting angles between cam lobe of the cams 71 and 72 and the valve 200 and so on, various valve duration may be performed.

Determinations of the control signals of the ECU according to the engine operation state is obvious to a person skilled in the art, thus detailed description will be omitted. As described above, a continuous variable valve duration system according to an embodiment of the present disclosure may vary an opening duration of a valve according to operation conditions of an engine, with a simple construction.

The continuous variable valve duration system according to an embodiment of the present disclosure may be reduced in size and thus the entire height of a valve train may be reduced.

Since the continuous variable valve duration system may be applied to an existing engine without excessive modification, thus productivity may be enhance and production cost may be reduced.

While this disclosure has been described in connection with what is presently considered to be practical embodiments, it is to be understood that the disclosure is not limited to the disclosed embodiments. On the contrary, it is intended to cover various modifications and equivalent arrangements included within the spirit and scope of the appended claims.

| <Description of symbols> | |
|---|---|
| 1: engine | 10: cylinder head |
| 20: head cover | 22: motor mounting portion |
| 30: camshaft | 32: camshaft hole |
| 40: cam cap | 42: shaft hole |
| 60: slider pin | 62: pin body |
| 63: slider pin hole | 64: pin head |
| 66: wheel hole | 70: cam portion |
| 70a, 70b: first/second cam portion | |
| 71, 72: cam | |
| 74: cam key | 76: cam cap engaging portion |
| 80: inner bracket | 80a, 80b: first/second inner bracket |
| 81: first sliding hole | 82: second sliding hole |
| 90: slider housing | 91: guide protruded portion |
| 92: double row bearing | 93: control slot |
| 95: slot cover | 99: bolt |
| 96: connecting bracket | 98: guide slot |
| 100: control portion | 102: eccentric control shaft |
| 104: worm wheel | 106: worm gear |
| 108: control motor | 200: valve |
| 201-204: 1-4 cylinder | |

What is claimed is:

1. A continuous variable valve duration system for an engine having a cylinder head, the system comprising:

a camshaft;

a cam portion having a cam formed thereto, the camshaft being inserted to the cam portion, wherein a relative phase angle with respect to the camshaft is variable, and wherein the cam portion further has a cam cap engaging portion formed thereto;

an inner bracket transmitting rotation of the camshaft to the cam portion;

a slider housing having the inner bracket rotatably inserted thereto, wherein the relative position of the slider housing with respect to the camshaft is variable, the slider housing having a control slot;

cam caps rotatably mounting the cam cap engaging portion to the cylinder head;

a control portion comprising an eccentric control shaft inserted into the control slot, a worm wheel connected to the eccentric control shaft, a worm gear engaged with the worm wheel, and a control motor selectively rotating the worm gear so as to change relative position of the slider housing with respect to the camshaft; and a cylinder head cover having a motor mounting portion where the control motor is mounted thereto.

2. The continuous variable valve duration system of claim 1, wherein the motor mounting portion is inclined to a side direction of the cylinder head cover.

3. The continuous variable valve duration system of claim 1, wherein:

the cam portion comprises a first and second cam portions, the cam being provided as a pair and formed to the first and second cam portions, respectively, and wherein the cam cap engaging portion is formed between the cams, respectively, and the inner bracket comprises a first and second inner brackets transmitting rotation of the camshaft to the first and second cam portions, respectively.

4. The continuous variable valve duration system of claim 3, further comprising:

a guide protruded portion formed to an upper portion of the slider housing; and a connecting bracket connecting the cam caps and having a guide slot for the guide protruded portion to be inserted thereto for guiding movement of the slider housing.

5. The continuous variable valve duration system of claim 4, wherein:

first and second sliding holes are formed to the first and second inner brackets respectively;

a slider pin inserted into the camshaft is rotatably inserted into the first sliding hole;

a cam key is formed to the first and second cam portions respectively; and a cam pin having a cam key slot for the cam key to be slidably inserted thereto, and is slidably inserted into the second sliding hole, respectively.

6. The continuous variable valve duration system of claim 5, wherein the slider pin comprises:

a pin body connected to the camshaft; and a pin head connected with the pin body and rotatably inserted into the first sliding hole.

7. The continuous variable valve duration system of claim 5, further comprising a double row bearing disposed within the slider housing and connected with the first and second inner brackets.

8. The continuous variable valve duration system of claim 4, wherein a shaft hole is formed between each cam cap and the connecting bracket for the eccentric control shaft to be inserted thereto.

9. The continuous variable valve duration system of claim 3, wherein:

a plurality of the first and second cam portions are provided; and a plurality of slider housings are provided; and wherein one control portion changes the relative positions of the slider housings with respect to the camshaft.

10. An engine comprising:

a camshaft;

at least two of a first and a second cam portions having two cams formed thereto, respectively, the camshaft being inserted to the at least two first and second cam portions, wherein relative phase angles of the at least two first and second cam portions with respect to the camshaft are variable, and of which a cam cap engaging portion is formed between the two cams respectively;

first and second inner brackets transmitting rotation of the camshaft to the first and second cam portions, respectively;

at least two slider housings having first and second inner brackets rotatably inserted thereto, of which relative positions with respect to the camshaft is variable and of which a guide protruded portion is formed to an upper side thereof respectively;

at least four cam caps each having a cam cap engaging portion rotatably connected thereto;

connecting brackets connecting the cam caps and having a guide slot for the guide protruded portion to be inserted thereto for guiding movement of the slider housing is formed thereto, respectively;

a control portion comprising an eccentric control shaft inserted into the control slot, a worm wheel connected to the eccentric control shaft, a worm gear engaged with the worm wheel and a control motor selectively rotating the worm gear so as to change relative position of the slider housing with respect to the camshaft; and a cylinder head cover of which a motor mounting portion where the control motor is mounted thereto.

11. The engine of claim 10, wherein the motor mounting portion is inclined to a side direction of the cylinder head cover.

12. The engine of claim 10, wherein:

first and second sliding holes are formed to the first and second inner brackets, respectively;

a slider pin inserted into the camshaft and rotatably inserted into the first sliding hole;

a cam key is formed to the first and second cam portions, respectively; and a cam pin having a cam key slot for the cam key to be slidably inserted thereto and is slidably inserted into the second sliding hole, respectively.

13. The engine of claim 12, wherein the slider pin comprises:

a pin body connected to the camshaft; and a pin head connected with the pin body and rotatably inserted into the first sliding hole.

14. The engine of claim 12, further comprising a double row bearing disposed within the slider housing and connected with the first and second inner brackets.

15. The engine of claim 10, wherein a shaft hole is formed between each cam cap and the connecting bracket for the eccentric control shaft to be inserted thereto.

* * * * *